US005739634A

United States Patent [19]

Kinoshita et al.

[11] Patent Number: 5,739,634

[45] Date of Patent: Apr. 14, 1998

[54] DOT MATRIX TYPE VACUUM FLUORESCENT DISPLAY TUBE

[75] Inventors: Kazuya Kinoshita; Tadami Maeda, both of Mie, Japan

[73] Assignee: Ise Electronics Corporation, Japan

[21] Appl. No.: 717,436

[22] Filed: Sep. 20, 1996

[30] Foreign Application Priority Data

Sep. 22, 1995 [JP] Japan ..... 7-244272

[51] Int. Cl.[6] ..... G09G 3/30

[52] U.S. Cl. ..... 313/496; 313/495; 345/75; 345/103; 345/47

[58] Field of Search ..... 313/495, 496, 313/497; 345/75, 74, 47, 103

[56] References Cited

U.S. PATENT DOCUMENTS

| | | | |
|---|---|---|---|
| 5,387,838 | 2/1995 | Hirakawa et al. | 313/496 |
| 5,510,672 | 4/1996 | Washio et al. | 345/75 |
| 5,548,185 | 8/1996 | Kumar et al. | 313/497 |

OTHER PUBLICATIONS

"18.4/10:15 A. M.: High Resolution Vacuum Fluorescent Display with 256×256 Dot Matrix" by Masao Uchiyama, Mitsuru Masuda et al. Ise Electronics Corpi., Ise Japan. p. p212 SID 82 Digest—p.p SID 82 Digest 213.

"18.7/12:00 Noon: A High Resolution Graphic Display" by Kiyoshi Morimotor Futaba Corp. Chiba Prefecture, Japan p.p. 218 SID 82 Digest—p.p SID 82 Digest 219.

"18.5/10.55 A.M.: High Resolution X–Y Dot Matrix VFD" by Robert P. Kiernan, T. Watanabe, et al. p.p 214 SID 82 Digest–SID 82 Digest 215.

*Primary Examiner*—Nimeshkumar Patel

*Attorney, Agent, or Firm*—Blakely Sokoloff Taylor & Zafman

[57] ABSTRACT

A dot matrix type vacuum fluorescent display tube includes anode electrodes, first and second wiring groups, an anode driver, light-emitting portions, a grid electrode, cathode electrodes, and an envelope. The anode electrodes are arranged in a matrix on a substrate. The first and second wiring groups extend in opposite directions with respect to the arrangement direction of the anode electrodes, and each of the first and second wiring groups is extracted from every other ones of the anode electrodes arranged in the matrix. The anode driver applies drive signals, respectively, to the anode electrodes connected to the first and second wiring groups. The light-emitting portions comprise phosphors and are formed on the anode electrodes. The grid electrode is arranged to be spaced apart from the light-emitting portions arranged in a matrix by a predetermined distance. The cathode electrodes are arranged above the grid electrode. The envelope is arranged to include at least the anode electrodes, the light-emitting portions, the grid electrode, and the cathode electrodes, and has a display portion thereon.

9 Claims, 4 Drawing Sheets

DOT MATRIX TYPE VACUUM FLUORESCENT DISPLAY TUBE

BACKGROUND OF THE INVENTION

The present invention relates to a dot matrix type vacuum fluorescent display tube that performs multi-color or monochromatic graphic display.

Conventionally, a dot matrix type vacuum fluorescent display tube of this type employs simple X-Y matrix driving or dynamic driving, e.g., anode three- or four-divisional driving when performing graphic display.

For example, in simple X-Y matrix driving, as shown in FIG. 7, 256×256 anodes 71 are arranged in a matrix, in which a horizontal array of 256 anodes 71 are connected in each of rows P1 to P256. 256 columns G1 to G256 of grids 72 are formed in a vertical direction perpendicular to the rows P1 to P256 to cover the 256 anodes 71.

While pulse signals as column signals (grid scanning) are sequentially applied to the 256 grids 72 of the columns G1 to G256, ON/OFF pulse voltages are selectively applied to the respective anodes 71 in synchronism with the column signals in accordance with their timings, thereby driving the respective anodes 71.

At this time, the scanning speed is set to such a level at which the human eye does not perceive flicker, and the vacuum fluorescent display tube performs a time-division pulse operation.

However, since such a dot matrix type vacuum fluorescent display tube is driven by dynamic driving, problems as follows occur.

First, in order to obtain a higher resolution, the number of dots may be increased, which increases the numbers of anodes and grids in turn. Conventionally, since dynamic driving is performed by sequentially applying time-divisional pulses to the grids and anodes, if the numbers of anodes or grids are increased, the duty cycle is shortened. Then, a voltage application time for each anode and each grid is shortened, leading to an increase in drive voltage required for obtaining a desired brightness.

As a result, expensive C-MOS elements having a high breakdown voltage and requiring a large current are used as the grid and anode drivers, resulting in an expensive drive circuit.

Second, as described above, when the number of dots is to be increased in dynamic driving, only a drive voltage corresponding to the duty component is applied to each anode. A practical brightness cannot be obtained unless the voltage is increased (for example, when an anode drive voltage of 90 V and a grid voltage of 70 V are applied with a duty ratio of 1/140 to 256× 16 pixels of ZnO:Zn phosphors, the brightness is about 130 FL).

In this manner, since driving must be performed at a comparatively high voltage, decomposition of the phosphor surface and the like occur. When multi-color phosphors (phosphors containing sulfur) are used, cathode degradation is caused, thus particularly shortening the service life of the tube.

The reason for this is assumed as follows. Various compound phosphors are available, e.g., oxide-based phosphors (ZnO:Zn and $ZnSiO_4$:Mn) and sulfide-based phosphors ((Zn,Cd)S:Ag and $Y_2O_2S$:Eu). Of these compound phosphors, a phosphor containing sulfur in its composition has a weak electronic coupling force with Zn or Cd serving as the cation. Thus, when an electron beam is irradiated on the sulfide phosphor, sulfur dissociates from Zn or Cd to form sulfur gas or $SO_x$ gas.

These gases are highly corrosive to degrade the surfaces of the cathode electrodes heated to a high temperature, thereby decreasing the amount of emission from the cathode electrodes.

Simultaneously, the surfaces of the phosphors are bombarded by electrons, so that the sulfide phosphors decompose, although slightly. Then, a normal stoichiometric phosphor composition cannot be maintained, and the light-emitting capability is decreased.

In dynamic driving as described above, since display is obtained by performing grid scanning, display flicker caused by external light or the resonance of the mechanical vibration of filaments is likely to occur. In order to prevent this, sufficient consideration must be paid in designing.

SUMMARY OF THE INVENTION

The present invention has been made to solve the conventional problems described above, and has as its object to provide a dot matrix type vacuum fluorescent display tube in which the number of components is decreased to obtain a practically sufficient emission brightness with low-voltage driving, and a high brightness and long service life are realized at a low cost.

In order to achieve the above object, according to the present invention, there is provided a dot matrix type vacuum fluorescent display tube comprising anode electrodes arranged in a matrix on a substrate, first and second wiring groups which extend in opposite directions with respect to an arrangement direction of the anode electrodes and each of which is extracted from every other ones of the anode electrodes arranged in the matrix, an anode driver for applying drive signals, respectively, to the anode electrodes connected to the first and second wiring groups, light-emitting portions comprising phosphors and formed on the anode electrodes, a grid electrode arranged to be spaced apart from the light-emitting portions arranged in a matrix by a predetermined distance, cathode electrodes arranged above the grid electrode, and an envelope arranged to include at least the anode electrodes, the light-emitting portions, the grid electrode, and the cathode electrodes and having a display portion thereon.

DESCRIPTION OF THE PREFERRED EMBODIMENTS

The preferred embodiments of the present invention will be described in detail with reference to the accompanying drawings.

Embodiment 1

Figure 1:
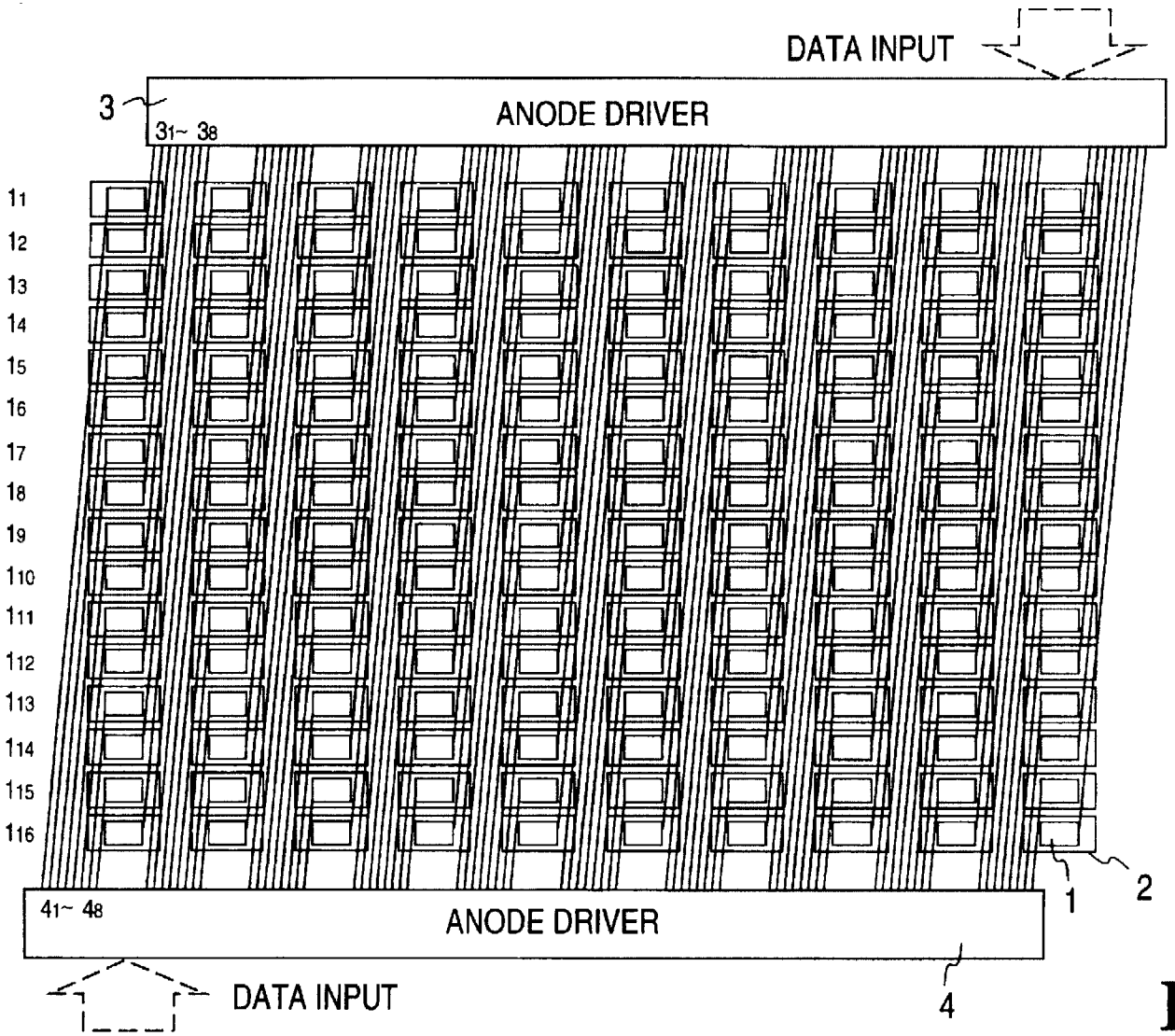
FIG. 1 is a plan view of the main part of a dot matrix display surface showing the arrangement of a dot matrix type vacuum fluorescent display tube according to an embodiment of the present invention.

FIG. 1 shows the arrangement of a dot matrix type vacuum fluorescent display tube according to Embodiment 1 of the present invention. FIG. 1 shows the main part of a 256×16 dot matrix display surface, in which the display surface in the horizontal direction is partly omitted.

As shown in FIG. 1, in this dot matrix type vacuum fluorescent display tube, a plurality of dot-like anode electrodes 1 in vertical and horizontal directions are arranged in a matrix at predetermined spaces between them. Light-emitting portions 2 comprising phosphors are respectively formed on the anode electrodes 1 to form the dot matrix display surface.

A first anode driver 3 and a second anode driver 4 each comprising low-voltage C-MOSs are arranged respectively on the upper and lower portions of this dot matrix display surface.

The output terminals of the first and second anode drivers 3 and 4 are alternately connected to the arrays of the anode electrodes i arranged in the vertical direction. The anode electrodes 1 and the output terminals of the anode drivers 3 and 4 are connected in a one-to-one correspondence.

In this embodiment, the direction of arrays of the matrix is in the vertical direction. However, the present invention is not limited to this, and the output terminals may be extracted in the horizontal direction.

For example, an explanation will be made by way of the first column of anode electrodes 1 arranged on the left end of the dot matrix display surface shown in FIG. 1.

Assuming that the anode electrodes 1 sequentially arranged in the vertical direction to form a column are defined as $1_1$, $1_2$, $1_3$, $1_4$, $1_5$, $1_6$, $1_7$, $1_8$, $1_9$, $1_{10}$, $1_{11}$, $1_{12}$, $1_{13}$, $1_{14}$, $1_{15}$, and $1_{16}$, output terminals $3_1$, $3_2$, $3_3$, $3_4$, $3_5$, $3_6$, $3_7$, and $3_8$ of the first anode driver 3 are respectively connected to the anode electrodes $1_2$, $1_4$, $1_6$, $1_8$, $1_{10}$, $1_{12}$, $1_{14}$, and $1_{16}$.

Output terminals $4_1$, $4_2$, $4_3$, $4_4$, $4_5$, $4_6$, $4_7$, and $4_8$ of the second anode driver 4 are respectively connected to the anode electrodes $1_1$, $1_3$, $1_5$, $1_7$, $1_9$, $1_{11}$, $1_{13}$, and $1_{15}$.

The second and following columns of the anode electrodes 1 are connected in the same manner.

In this manner, since the first and second anode drivers 3 and 4 are alternately connected to the columns of anode electrodes arranged in one direction, the density of arrangement of the anode electrodes can be increased.

Although not shown, one mesh-like grid electrode for electron diffusion is arranged above the dot matrix display surface to oppose to and cover the dot matrix display surface.

A plurality of wire-like cathode electrodes having surfaces coated with an oxide are extended above the mesh-like grid electrode as electron sources.

The dot matrix type vacuum fluorescent display tube having the above arrangement is driven to be lit in the following manner.

Input data corresponding to image signal information output from an image signal storage circuit (not shown) are input to the first and second anode drivers 3 and 4. Thus, anode electrodes 1 corresponding to these image signals are selected by the first and second anode drivers 3 and 4 and an anode voltage is supplied to them.

At this time, a predetermined voltage is applied to the cathode and grid electrodes, and electrons generated by the cathode electrodes and extracted by the grid electrode are incident on the light-emitting portions 2 of the selected anode electrodes 1.

Hence, a dot selected by static driving emits light to perform graphic display.

Figure 2:
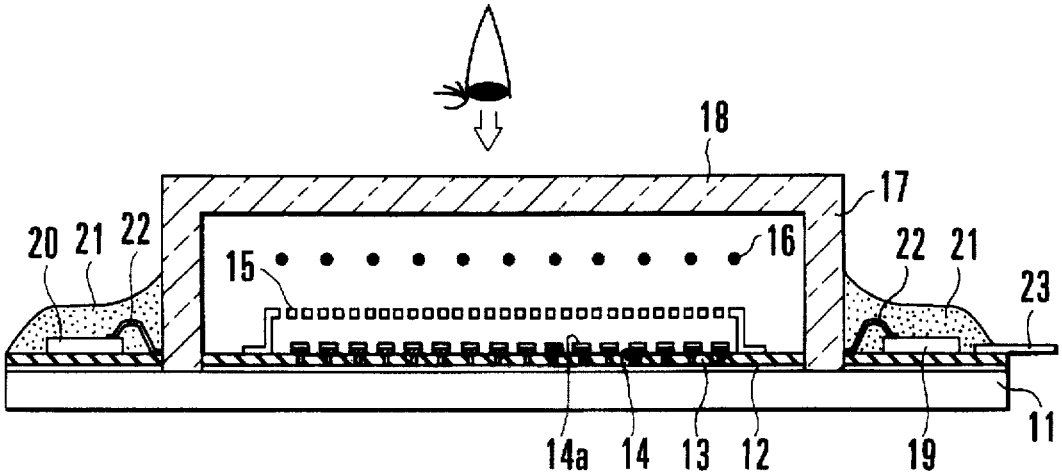
FIG. 2 is a sectional view of the main part of the arrangement of the dot matrix type vacuum fluorescent display tube according to the embodiment of the present invention.

FIG. 2 shows the arrangement of the dot matrix type vacuum fluorescent display tube according to Embodiment 1.

As shown in FIG. 2, an aluminum wiring 12 for transmitting/receiving signals is formed on a glass substrate 11, and an insulating film 13 is formed on the wiring 12.

Anode electrodes 14 formed on the insulating film 13 and the wiring 12 are connected to each other through through holes formed at predetermined portions on the insulating film 13.

As shown in FIG. 1, the plurality of anode electrodes 14 are arranged in a matrix, and light-emitting portions 14*a* comprising phosphors are formed on the respective anode electrodes 14 to constitute a display surface (phosphor screen).

One mesh-like grid electrode 15 is arranged above the phosphor surface to oppose it, and a plurality of wire-like cathode electrodes 16 are disposed above the grid electrode 15.

A transparent cover glass member 18 is arranged above the grid electrode 15 and the cathode electrodes 16 through a spacer glass member 17 arranged at a predetermined position on the glass substrate 11.

The glass substrate 11, the spacer glass member 17, and the cover glass member 18 are sealed by frit glass to constitute an envelope the interior of which is hermetically sealed.

A first driver chip 19 and a second driver chip 20 are arranged at the end portions outside the envelope of the glass substrate 11 by die bonding. The first and second driver chips 19 and 20 respectively incorporate the first and second anode drivers 3 and 4 described with reference to FIG. 1.

The output terminals of the first and second anode drivers 3 and 4 are connected to the wiring 12 formed on the surface of the glass substrate 11 through bonding wires 22 and are connected to the anode electrodes 14 in a one-to-one correspondence.

The first and second driver chips 19 and 20 are coated with a molding resin 21. The molding resin 21 protects the first and second driver chips 19 and 20, the bonding wires 22, and the like from external factors.

In this dot matrix type vacuum fluorescent display tube, input data corresponding to image signal information output from, e.g., an image signal storage circuit (not shown) and a power supply voltage are input to the first driver chip 19 through an external lead 23.

According to this arrangement, since static driving is performed, a grid scanning driver is unnecessary. Since an inexpensive C-MOS not requiring a high breakdown voltage and a large current can be used as the anode driver, the cost of circuits and the apparatus is decreased.

Since grid scanning is unnecessary, display flicker caused by external light and the resonance of mechanical oscillation of filaments is eliminated, thus simplifying the design of the flicker preventing structure.

Since static driving is performed, the voltage applied to the respective anode electrodes has a duty ratio of 1 and is thus supplied to the anode electrodes directly.

Therefore, even with DC low-voltage (20 V or less) driving, a practically sufficient brightness can be obtained. This applies even if the number of dots is increased. In contrast to this, in dynamic driving, when the number of dots is increased, the duty ratio is decreased accordingly, and a voltage of about 100 V to 130 V must be applied to obtain a sufficiently high brightness, leading to the necessity for a high-breakdown-voltage driver, a booster circuit, and the like.

Since low-voltage driving is enabled, an increase in service life of the cathodes serving as the electron emitting sources can be achieved. In addition, an increase in service life of the vacuum fluorescent display tube resulting from an increase in service life of the phosphors themselves forming the phosphor surface can be achieved as a subsidiary effect.

As has been described regarding the problems to be solved by the invention, in driving a vacuum fluorescent display tube, in particular a multi-color vacuum fluorescent display tube using sulfide phosphors, the lower the drive voltage, the longer the service life.

In this embodiment, unlike in the conventional case, static driving is performed, so that low-voltage driving is enabled even in a dot matrix type vacuum fluorescent display tube, thus achieving a high brightness and a long service life.

In the above description, the first and second driver chips 19 and 20 are connected to the wiring 12 through the bonding wires 22. However, the present invention is not limited to this.

Figure 3:
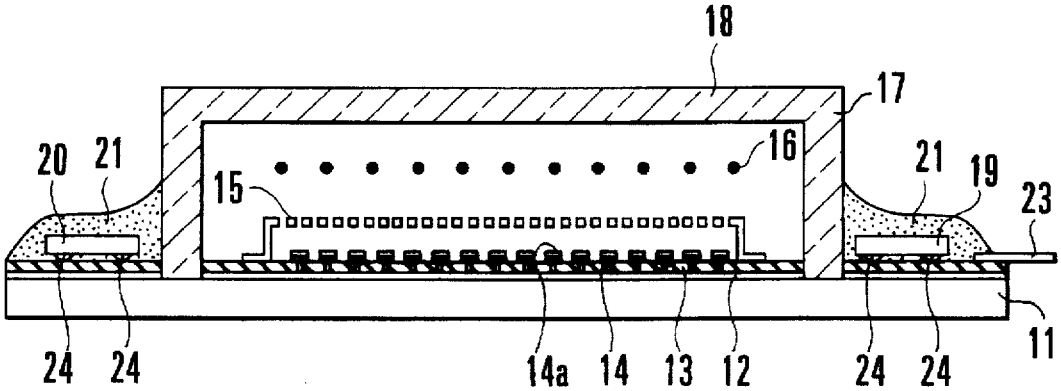
FIG. 3 is a sectional view of the main part of the arrangement of a dot matrix type vacuum fluorescent display tube according to another embodiment of the present invention.

As shown in FIG. 3, a first driver chip 19, a second driver chip 20, and a wiring 12 may be connected to each other through gold bumps 24.

Embodiment 2

Figure 4:
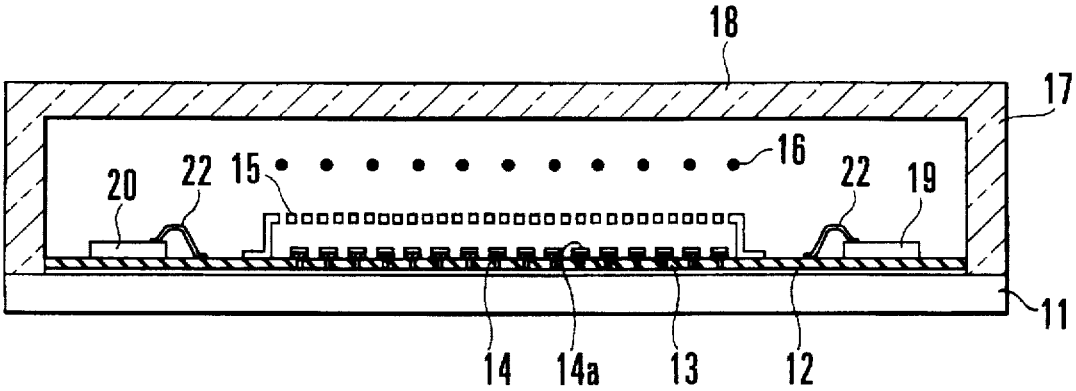
FIG. 4 is a sectional view of the main part of the arrangement of a dot matrix type vacuum fluorescent display tube according to still another embodiment of the present invention.

FIG. 4 shows the arrangement of a dot matrix type vacuum fluorescent display tube according to another embodiment of the present invention. In FIG. 4, the same portions as in FIG. 2 are denoted by the same reference numerals.

As shown in FIG. 4, in Embodiment 2, a first driver chip 19, a second driver chip 20, and bonding wires 22 are arranged inside the envelope.

With this arrangement, in Embodiment 2, unlike in Embodiment 1, the first and second driver chips 19 and 20 and the bonding wires 22 can be protected from external factors without requiring a molding resin 21 shown in FIG. 2.

Embodiment 3

In Embodiments 1 and 2, the driver chips are formed on the same substrate commonly used by the vacuum fluorescent display tube. However, the present invention is not limited to this, and substrates for the driver chips and a substrate for the vacuum fluorescent display tube can be formed separately.

Figure 5:
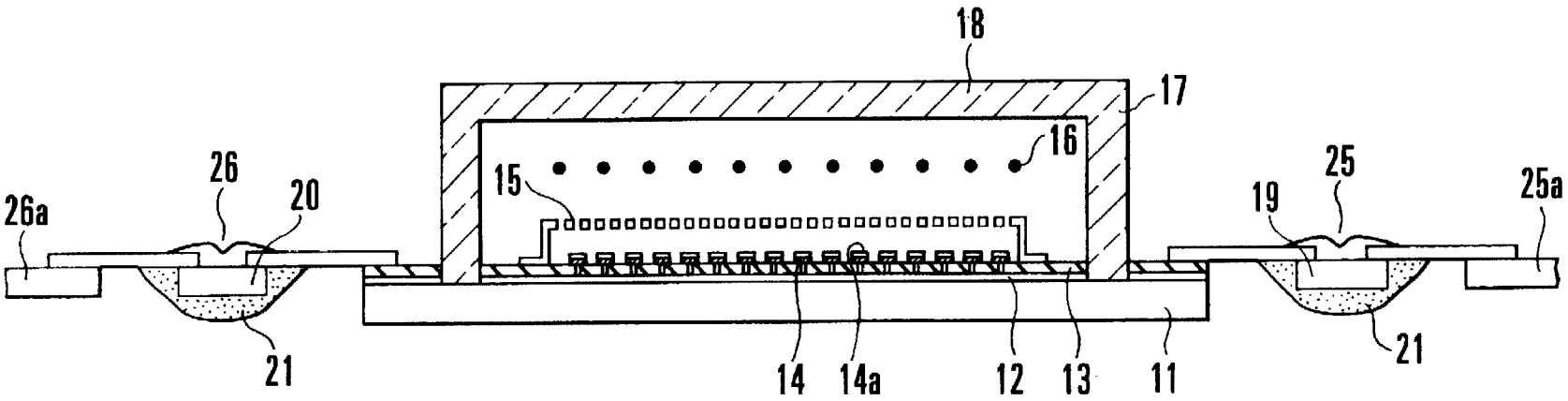
FIG. 5 is a sectional view of the main part of the arrangement of a dot matrix type vacuum fluorescent display tube according to still another embodiment of the present invention.

FIG. 5 shows the arrangement of a vacuum fluorescent display tube system using a dot matrix type vacuum fluorescent display tube according to Embodiment 3. The same portions as in FIG. 2 are denoted by the same reference numerals.

As shown in FIG. 5, a first driver chip 19 is formed on a plastic film 25 having an inner lead and an outer lead such that its electrode terminal is connected to the distal end of the inner lead by soldering.

Similarly, a second driver chip 20 is formed on a plastic film 26 such that its electrode terminal is connected to the distal end of the inner lead of the plastic film 26 by soldering.

The outer leads of the plastic films 25 and 26 are connected to a wiring 12 of the dot matrix type vacuum fluorescent display tube.

The other end of the lead terminal of the plastic film 25 is soldered to another substrate **25*a*. Although not shown, an image signal storage circuit and the like are mounted on the substrate 25*a* to input to the first driver chip 19** a power supply voltage and input data corresponding to the image signal information.

Similarly, the other end of the lead terminal of the plastic film 26 is soldered to still another substrate **26*a***.

The first and second driver chips 19 and 20 are coated with a molding resin 21 as required so that they are protected from external factors.

In Embodiment 3, the first driver chip 19 is mounted on the plastic film 25 and coated with the molding resin 21. However, the present invention is not limited to this.

Figure 6:
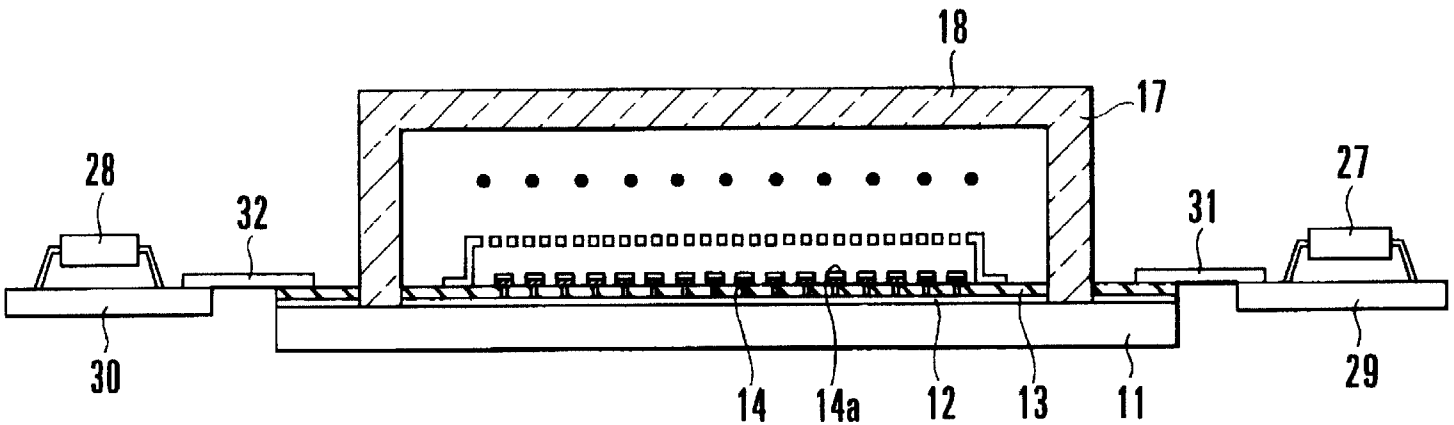
FIG. 6 is a sectional view of the main part of the arrangement of a dot matrix type vacuum fluorescent display tube according to still another embodiment of the present invention.
Figure 7:
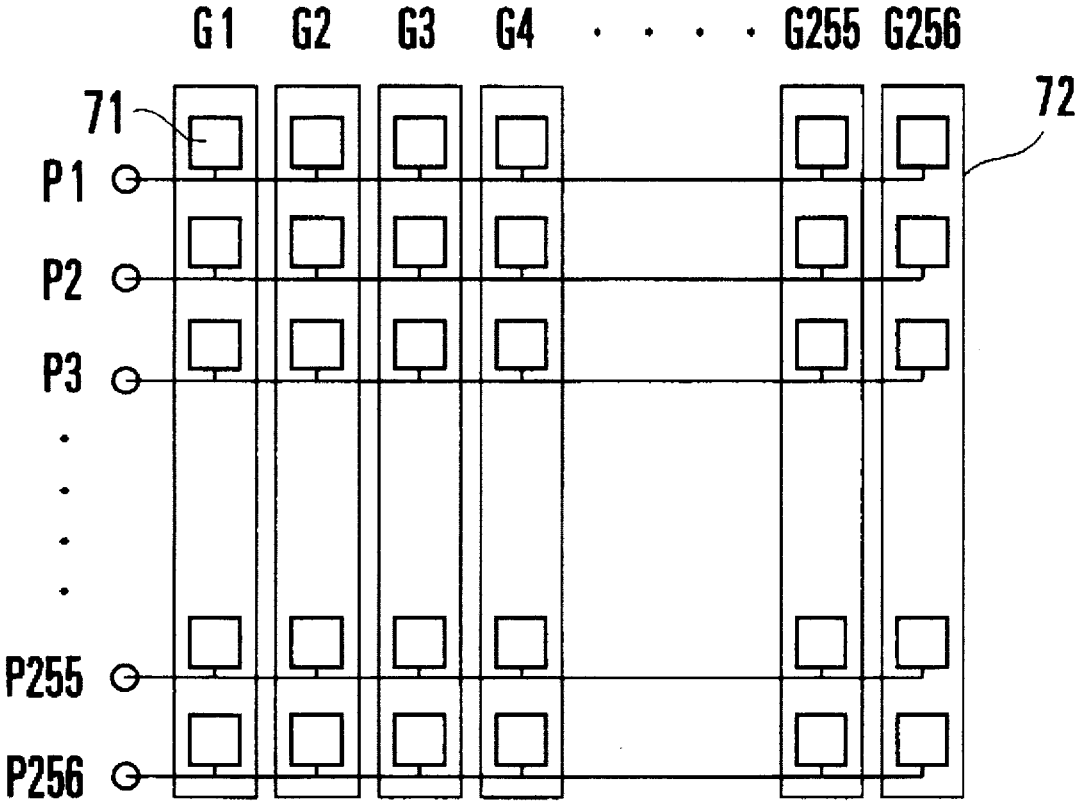
FIG. 7 PRIOR ART
FIG. 7 is an explanatory diagram showing conventional simple X-Y matrix driving.

As shown in FIG. 6, first and second driver packages 27 and 28 respectively incorporating first and second anode drivers 3 and 4 identical to those described with reference to FIG. 1 may be formed to have flat package structures. In this case, the first driver package 27 is mounted on a chip mounting substrate 29, and its electrode terminal is connected to the lead of a plastic film 31 and then to a predetermined position on a wiring 12 on a glass substrate 11.

Similarly, the second driver package 28 is mounted on a chip mounting substrate 30, and its electrode terminal is connected to the lead of a plastic film 32 and then to a predetermined position on the wiring 12 on the glass substrate 11. In FIG. 6, the same portions as in FIG. 2 are denoted by the same reference numerals.

In this manner, since the glass substrate 11 and the chip mounting substrates 29 and 30 are connected to each other through the plastic films 31 and 32, respectively, the degree of freedom in their arrangement and mounting is improved.

As has been described above, the present invention comprises first and second wiring groups which extend in opposite directions with respect to the arrangement direction of the anode electrodes and each of which is extracted from every other ones of anode electrodes arranged in a matrix on a substrate, and anode drivers for applying drive signals to the respective anode electrodes connected to the first and second wiring groups.

As a result, the phosphor surface can be driven by static driving, and the drive voltage applied to each anode electrode can be decreased.

Since the dot matrix type vacuum fluorescent display tube according to the present invention can be driven at a lower voltage, a high brightness and a long service life can be obtained at a low cost, while largely improving the quality and reliability, that are very excellent effects.

Since the wires are alternately connected to the anode electrodes arranged in one direction, the density of arrangement of the anode electrodes can be increased.

What is claimed is:

1. A dot matrix vacuum fluorescent display tube comprising:

anode electrodes arranged in a matrix on a substrate, said matrix having two ends;

first and second anode drivers, said first anode driver positioned on one end of the matrix and said second anode driver positioned on the second end of said matrix for applying drive signals, respectively, to said anode electrodes;

first and second wiring groups extending in opposite directions wherein said anode electrodes are connected alternatively in a one-to-one correspondence to said wires in said first and second wiring groups, said first wiring group connected to said first anode driver and said second wiring group connected to said second anode driver such that said anode electrodes have a one-to-one correspondence to said anode drivers;

light-emitting portions including phosphors and formed on said anode electrodes;

a grid electrode arranged to be spaced apart from said light-emitting portions arranged in a matrix by a predetermined distance;

cathode electrodes arranged above said grid electrode; and an envelope arranged to include at least said anode electrodes, said light-emitting portions, said grid electrode, and said cathode electrodes and having a display portion thereon.

2. A tube according to claim 1, wherein the first and second anode drivers are respectively formed on first and second chip mounting substrates connected to the substrate through flexible films to oppose each other.

3. A tube according to claim 1, wherein said anode driver is formed on said substrate outside said envelope.

4. A tube according to claim 1, wherein said anode driver is formed on said substrate in said envelope.

5. A tube according to claim 1, wherein said anode driver is formed on a flexible film connected to said substrate.

6. A tube according to claim 1, wherein said anode driver is formed on a chip mounting substrate connected to said substrate through a flexible film.

7. A tube according to claim 1, wherein said first and second anode drivers are formed on said substrate outside said envelope to oppose each other.

8. A tube according to claim 1, wherein said first and second anode drivers are formed on said substrate in said envelope to oppose each other.

9. A tube according to claim 1, wherein said first and second anode drivers are respectively formed on first and second flexible films connected to said substrate to oppose each other.

* * * * *